US005577637A

United States Patent [19]

Voss

[11] Patent Number: 5,577,637

[45] Date of Patent: Nov. 26, 1996

[54] CUTTING-OFF DEVICE FOR STOCK MATERIALS PACKED IN CAN-LIKE CONTAINERS, MORE PARTICULARLY FILLER MATERIALS AND PUTTIES AND HARDENER PASTES

[75] Inventor: Klaus-Wilhelm Voss, Uetersen, Germany

[73] Assignee: Vosschemie GmbH, Uetersen, Germany

[21] Appl. No.: 360,145

[22] Filed: Dec. 20, 1994

[30] Foreign Application Priority Data

Sep. 1, 1994 [DE] Germany ..... 9414136 U

[51] Int. Cl.[6] ..... B67D 5/52

[52] U.S. Cl. ..... 222/137; 137/625.18; 220/345; 222/327; 222/389; 222/485; 222/561

[58] Field of Search ..... 222/135, 137, 222/325, 326, 327, 386, 389, 485, 561; 220/212, 345, 346, 351; 137/255, 625.18

[56] References Cited

U.S. PATENT DOCUMENTS 4,871,090 10/1989 Hoffmann ..... 222/326 X
5,083,672 1/1992 Lewandowski ..... 222/561 X
5,248,067 9/1993 Garcia ..... 222/561 X
5,294,024 3/1994 David et al. ..... 222/137

FOREIGN PATENT DOCUMENTS 2039842 8/1980 United Kingdom ..... 222/561
9105731 5/1991 WIPO ..... 222/137

*Primary Examiner*—Joseph Kaufman
*Attorney, Agent, or Firm*—Friedrich Kueffner

[57] ABSTRACT

Cutting-off device for viscous stock materials packed in can-like containers, more particularly filler materials and putties and hardener pastes. A device in the form of a disposable article for the simultaneous cutting-off of filler materials and hardener pastes dispensed from can-like containers can be mounted upon the dispensing apertures of the containers and includes a mounting plate (10) with connection pieces (12,32) and with dispensing apertures constructed within the upper region in the mounting plate and of a slider (40) displaceably retained and guided on the mounting plate (10), which, in dependence of the assumed position, closes or unblocks the dispensing apertures, and of two cutters that are moveable into the areas of the dispensing apertures.

18 Claims, 6 Drawing Sheets

CUTTING-OFF DEVICE FOR STOCK MATERIALS PACKED IN CAN-LIKE CONTAINERS, MORE PARTICULARLY FILLER MATERIALS AND PUTTIES AND HARDENER PASTES

BACKGROUND OF THE INVENTION

1. Field of the Invention

The present invention relates to a device for simultaneously cutting-off viscous stock materials, such as, filler materials or putties and hardener pastes, that are dispensed from can-shaped containers having a displaceable pressing cover and being provided with closable discharge orifices. The containers are disposed in a supporting frame or structure which is provided with centering mounting means for the containers and an extrusion means having simultaneously operable piston rods. The piston rods have piston plates at the ends thereof which are displaceable in the interiors of the containers in a direction toward the discharge orifices of the containers.

2. Description of the Related Art

It is often considered disadvantageous that it is sometimes not possible to completely empty especially can-shaped containers whose contents weigh several kilograms and which contain viscous materials, more particularly filler materials and putties. If the containers can be emptied, emptying the containers requires a considerable amount of work and additional tools, such as, spatulas or the like. However, this additional work is usually not carried out, so that residues of the contents remain in the containers and are subsequently discarded with the containers. Added to this is the fact that, in some designs, the contents of the containers are very difficult to manipulate because of the highly viscous consistency of the materials. In addition, in some designs, it is considered a disadvantage that the application of stock material and hardener paste onto a spatula always takes place in such a way that the two materials must subsequently be mixed together.

Since the discharge apertures of the containers containing the filler material and the hardener paste are sometimes located fairly far apart, it may happen that a portion of the materials to be mixed flows past the spatula which has relatively small dimensions.

Numerous devices have been developed for dispensing two-component materials.

DE-A 25 37 002 discloses a hand-held dispenser for two-component materials with cartridges containing disposable material, with a disposable mixing head and with disposable connecting lines. This dispenser includes a pair of cartridges, accommodation spaces for the cans which, on oppositely located ends, are open through one end for receiving the cartridges containing and for dispensing the material. The other end of the cartridge extends through the oppositely located end of the can. A cartridge piston is disposed within the region of the one end of the can. The device further includes a piston assembly with a pair of piston heads provided on the ends of a pair of piston rods and interconnected for moving simultaneously, and a basic assembly for moving the piston heads into the operating position relative to the cartridge pistons. Also provided is a mixing head attaching and mounting assembly for the detachable attachment and mounting of the mixing head, wherein the two cartridges, the mixing head and the connecting lines for dosing, mixing and dispensing the two-component materials communicate with the dispenser and can be removed after use for the reuse of the dispenser with replacement cartridges. The device also has a replacement mixing head and replacement connecting lines, whereby a manipulatable and portable mixing and dispensing means is to be provided, with the aid of which a large number of two-component materials can be readily dosed, mixed and dispensed in larger quantities than had been possible in the past from a single cartridge, in order to make it possible to use inexpensive disposable cartridges and other disposable component parts which can be made available in the form of a kit for repeated use with the device.

The known hand-held dispenser for two-component materials has a construction in which two socket-like accommodation chambers are provided for the cartridges in a mounting means, wherein, after the cartridges have been inserted into the accommodation chambers, the cartridges are swung toward a supporting plate by means of hinge-like mountings, so that the cartridges are located in the path of advance of the pressing plungers. The discharge apertures of the cartridges or of the mounting means which project over the cartridges communicate via pipelines with a dispensing nozzle, wherein the dispensing nozzle is constructed in the form of a dispensable nozzle and is replaced by a new one after use.

It is a disadvantage in this known dispenser that, after the cartridges are emptied, the mixing heads are filled with filler material and hardener paste deposits which, when the dispenser is not operated for some time, become encrusted or harden, so that it will then be necessary to replace the mixing head. In addition, in this known dispensing means for two-component materials, the pipelines for conveying the material to be pressed out are not disposed on the supporting structure, but on the aperture projection of the container itself, so that the problem of sealing between the supporting structure and container does not arise. There is also no problem when the containers dispense the pressed-out material directly without the interposition of a further pipeline.

U.S. Pat. No. 3,957,176 shows a device for mounting a container with a filling means provided at the bottom part of the container for dispensing the container contents. This known device has a floor rack having two supporting members proceeding parallel to each other as support for the container. Lateral lugs or studs delimit the container set up in this manner, wherein the container is positionally secured with the aid of a set screw. The dispensing of the container contents is effected by the employment of compressed air. For this reason, the cover portion of the container has a rigid and airtight connection for the required pressure line, while the bottom portion of the container is provided with an opening as the discharge aperture constructed in the form of a threaded pipe portion. In this known device, it is disadvantageous that the filling means must be connected to the respective container to be emptied within the region of the discharge aperture in the bottom portion of the container. Since the filling means is attached to the bottom portion of the container, an alignment and centering of the container to a filling means rigidly secured in the supporting structure is not necessary because the latter forms a part of the container. Accordingly, the filling means is not a permanent component part of the means for carrying the container, but constitutes a special part which, when the container is to be used, has to be placed upon the circumferential rim delimiting the discharge aperture. However, viscous filler materials can only be pressed out of the container or cartridge by employing a high pressure. The larger the container dimensions, the greater the pressure that has to be applied will be. A filling means which is merely mounted on the rim forming the discharge aperture can subsequently easily become leaky within the connecting area, especially when it becomes necessary to make use of high pressures for squeezing out the container contents. In contrast, when the attachment of the filling means is effected with the aid of a screw thread on the bottom portion of the container, a relatively great effort is necessary for preparing the container for operation.

IT-A-834 936 shows a device for accommodating three cartridges, wherein the contents of the three cartridges can be pressed out simultaneously. This known device has a supporting frame with centering mounts for the cartridges containing the materials to be dispensed and a squeezing-out means with simultaneously operable piston rods with piston plates disposed at the ends thereof and displaceable in the interiors of the cartridges toward the centering mounting means, wherein the cartridges to be employed in this device have a cross-sectional configuration and dimensions corresponding to those of the centering mounting means. Dispensing of the materials from the cartridges, not shown in IT-A 834 936, is probably effected by means of nozzle-like discharge apertures similar to those shown in DE-A 25 37 002, wherein the discharge apertures of the three cartridges are disposed so as to be spaced apart fairly far, so that, when the materials to be mixed are dispensed onto a spatula, a portion of the materials will flow past the spatula which has relatively small dimensions. In addition, this device is operated manually and each individual cartridge has to be provided with a discharge sleeve because the mounting of the cartridges in the device is not effected exclusively by the supporting frame structure, but with the aid of the discharge sleeves on the cartridges which are retained in recesses of the end plates of the supporting frame of the device.

What is disadvantageous in this device is the fact that the device is exclusively operated by hand and that, following the termination of the squeezing-out operation, material still continues to flow from the cartridges and this subsequent flow can only be stopped by discontinuing the pressure of the pressing piston acting on the material by withdrawing the main piston rod.

U.S. Pat. No. 4,033,480 describes a device for simultaneously dispensing two different media from two separate containers. This device includes a base plate with two openings that communicate with delivery or outlet valves. Two containers are disposed on the base plate, wherein the bottom of each container is provided with a discharge aperture. Within the region of these discharge apertures, the bottoms of both containers have externally located studs, such that the studs engage into the openings in the base plate when the container is disposed on the base plate. The stirrup-like locking means provided in this device do not serve exclusively for positionally securing the two containers on the base plate, but also for the retention of the cover portions of the two containers on the containers themselves since the entire device is operated with the aid of compressed air. A piston plate is disposed in each container above the material contained therein. The piston plate can be acted upon by compressed air, so that the materials can be pressed out of the two containers after the discharge valves have been opened.

This device has the disadvantage that the piston plates in the interiors of the two containers are actuated by means of compressed air. It is possible that compressed air will flow through the interspace between piston plate and container wall since a complete sealing within the marginal area of each container is problematic. That is why, when emptying the containers down to the last material residue, it cannot be avoided that this residue is pressed out of the opened delivery valves at a relatively high pressure, so that splashing or spattering of the material flowing out of the containers may occur.

In addition, in the known device, the two containers are centered on their base plates solely by means of their studs. Each container is merely placed upon its base plate and the container has to be displaced until the stud provided within the region of the bottom discharge aperture of the container engages into the opening of the base plate. Particularly, when large-volume containers having a relatively great weight are involved, this is a relatively laborious procedure to shift the container on its base plate until, by pure chance, the opening in the base plate is found, so that the external stud in the area of the discharge aperture in the bottom portion of the container engages into the opening of the base plate.

The containers used in this device have studs on the container bottom plates, wherein the studs are formed externally within the region of the container bottom discharge apertures. Consequently, the stud is not located in the plane formed by the bottom plate of each container. As a result, containers constructed in this manner cannot easily be placed on their bottom sides so as to stand upright on an even surface. Moreover, it is difficult to stack the containers constructed in this manner one on top of the other. The cover portions of the containers are detachable and, due to the use of compressed air, the cover portions have to be retained so as to fit firmly on the container bodies, which is effected with the aid of the stirrup-like or bracket-like arresting means.

Due to the external stud provided in the containers of this device within the region of the bottom discharge apertures, it is possible, when large and heavy containers are involved, that the entire bottom portion may be pressed in when the containers are put down on a plane surface, so that the external stud provided within the region of the bottom discharge aperture comes to lie in the plane which is formed by the circumferential rim of the bottom plate of the container, so that, in turn, after a container damaged in this manner is placed on the base plate of the device, the stud is no longer capable of engaging in the openings of the base plate and, when the device is operated for dispensing material, the material may run out between the bottom portion and the base plate and harden there. Encrustations may form in this area and it cannot be excluded that hardened material particles find their way into the material to be pressed out.

Furthermore, in this known device, the delivery valves for the two containers are disposed at a relatively great distance from each other, so that the materials from the two containers cannot be pressed out in such a way that they are located close to one another. Due to the fact that a pressurization of the pressing-out pistons takes place by means of the gas pressure, the containers are fixed by transmitting the pressing force of the pressing pistons to the container bottoms, wherein the container bottoms are pressed against the base plates by the pressing force. However, the gas pressure forces acting on the container covers must be supported and absorbed by screwing buttons and clamping brackets on the supporting frame. However, in order to render this additional pressing on by the pressing forces effective, the container covers must not be connected with positive engagement to the containers because otherwise the gas forces acting upon the container covers would not allow the pressing forces required for the fixation to become effective. Rather, the container covers must be pressed in a gas-tight fashion against the containers with the aid of the screw bottons and clamping brackets secured to the supporting frame. In this device, a sealing of the thread of the container covers by means of clamping brackets is always necessary.

All these known dispensing devices for two-component materials have in common that expensive constructions are necessary and the mixing and dosing heads have to be thoroughly cleaned even after a brief period of use and operation of the devices in order to prevent that small hardened material particles penetrate into the material to be pressed out which would lead to a reduction of the quality of priming operations carried out with the material or would require additional grinding operations of the hardened surfaces.

Therefore, it is the primary object of the present invention to provide a device of the above-described type which is simple to handle and inexpensive to manufacture and can be used in the form of a disposable article. It should be possible by means of the device to simultaneously dispense filler materials and hardener pastes and to mount the device on the discharge apertures of the can-shaped containers containing the filler material and hardener paste. At the same time, when the device is mounted on the containers, the device should seal the discharge apertures of the containers.

SUMMARY OF THE INVENTION

In accordance with the present invention, the cutting-off device can be mounted or inserted on or into the discharge orifices of the two containers for the stock material and hardener paste and includes a mounting plate with a first dispensing aperture for the stock material and a second dispensing aperture for the hardener paste located at a distance from the first dispensing aperture. Within the area of each dispensing aperture of each container, a connection piece is operatively connected on the mounting plate to the respective discharge orifice of each container and, on the side of the mounting plate facing away from the connection piece, first and second guideways are provided for a slider. The slider is provided with a grip and serves to close the dispensing apertures in the mounting plate. The slider additionally has two cutters which are movable into the regions of the dispensing apertures in the mounting plate.

Accordingly, the cutting-off device according to the invention is composed substantially of two component parts, i.e., a mounting plate including the connection piece forming the dispensing apertures. The mounting plate connects the cutting-off device to two can-shaped containers which contain the filler material and the hardener paste and has guideways for a slider. The slider constitutes the second component part and is constructed in such a way that, when dispensing the materials, the dispensing orifices are open and, when the slider is closed, the dispensing orifices are blocked, so that the discharge apertures of the two containers are closed at the same time. In addition, the slider is provided with cutters for cleanly cutting the dispensed materials from the remaining strand of material after the desired and required quantities of the materials have been pressed out of the containers.

The cutting-off device can be mounted by means of the connection plate on the two can-shaped containers for the stock material in such a away that the connection pieces engage into the discharge orifices or engage over the discharge orifices when the discharge orifices for the two materials are formed by container connecting pieces.

The cutting-off device is composed of a mounting plate with two spaced-apart dispensing apertures for the stock material and the hardener paste, wherein, within the region of each dispensing aperture, one connecting piece each on the mounting plate is placed into operative connection with the respective discharge orifice of each container. On the side of the mounting plate facing away from the connecting piece, a first guideway and a second guideway are provided for a slider which includes a grip. The slider closes the dispensing apertures in the mounting plate and has two cutters that are movable into the areas of the dispensing apertures in the mounting plate.

When the slider is operated, the dispensing apertures for the stock material and hardener paste are closed and opened. The slider is guided on the mounting plate in such a way that a problem-free operation is achieved and the materials are prevented from flowing into the interspace between mounting plate and slider.

Handling of the cutting-off device according to the invention is extremely simple and not time consuming since the cutting-off device is inserted with its two connecting pieces into the discharge orifices or mounted on the dispensing connecting pieces of the containers forming the discharge orifices and since the two interacting component parts of the cutting-off device are composed of plastic materials, more particularly elastic plastic materials, a firm fit of the connecting pieces of the cutting-off device on the discharge orifices or dispensing apertures of the two containers is ensured.

The device according to the present invention makes it possible that the mounting plate and the slider of the cutting-off device interact in such a way that the slider with its two cutters is held down on the mounting plate by means of the guideways, so that an air tight closure of the discharge orifices of the two containers in the closing position of the slider is achieved. The bead-like guideways on the slider prevent the slider from becoming deformed; it has been found in practical operation that deformations of components of plastic material are caused in particular due to the fact that the solvents contained in the materials or pastes to be mixed diffuse through the material of the cutting-off device, in particular through the material of the slider, so that the material consistency is altered which, in turn, means that the interacting component parts are deformed and leaks may occur.

It is particularly advantageous in this connection that the cutters of the slider, more particularly the cutter for the filler material, are located approximately 1–2 mm above the end of the guide plate of the mounting plate on which the cutters are guided. This construction prevents cut-off material from dropping down. After the cutting-off operation, the material remains on the free projecting end of the plate-shaped blank forming the guide for the filler material and can be easily removed after hardening.

The guideways of the components of the cutting-off device which are movable in relation to each other produce the result that, apart from providing an improvement in the inherent rigidity and stability, the cutters are guided planely on their supports.

The special advantage of this cutting-off device according to the invention resides in that, when a new container for filler material and/or a cartridge for hardener paste is supplied, this cutting-off device is supplied with the container or cartridge, so that the consumer receives a new, clean cutting-off device which is not contaminated with residue and costly cleaning of used devices is unnecessary.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
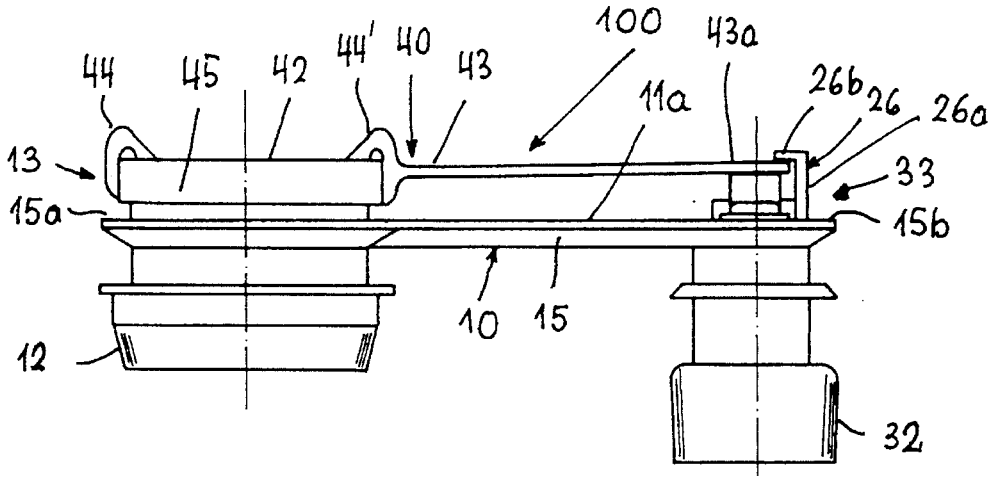
FIG. 1 is a side view of the cutting-off device with a mounting plate and a slider with two cutters.
Figure 2:
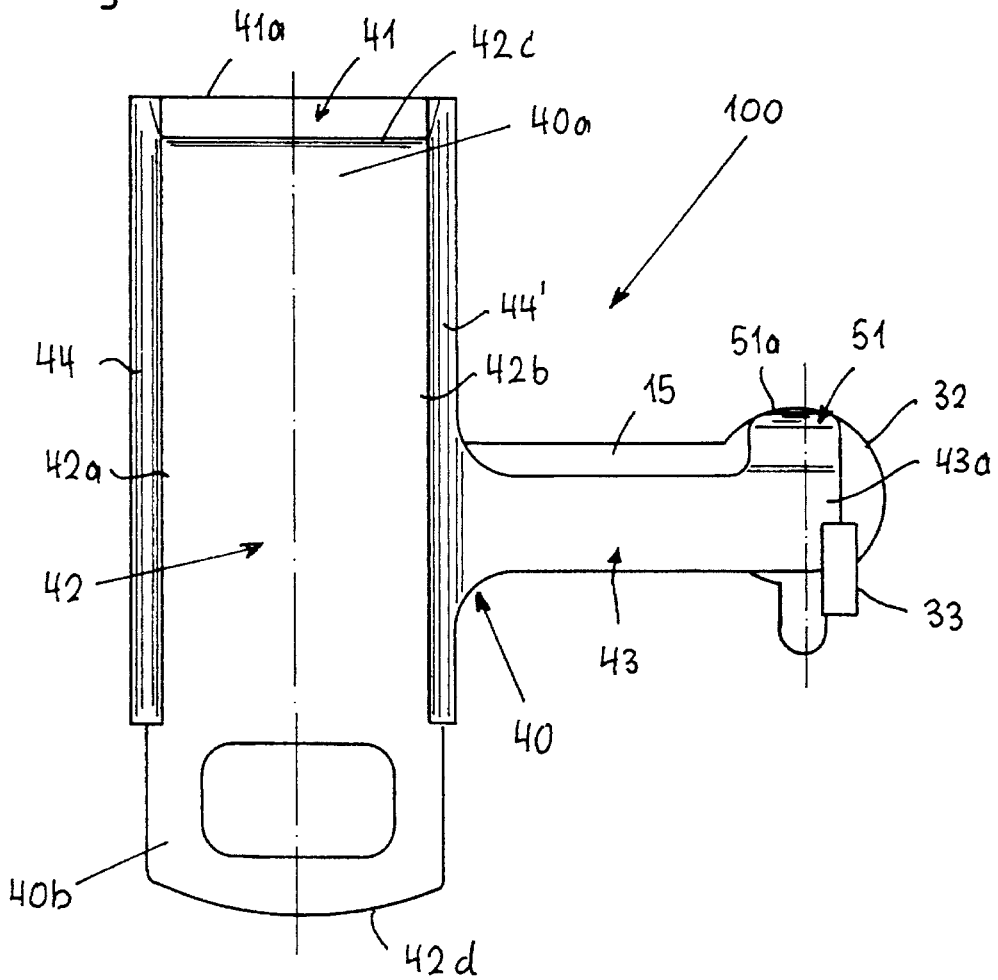
FIG. 2 is a top view of the cutting-off device in a position in which the slider closes the dispensing apertures of the device.
Figure 3:
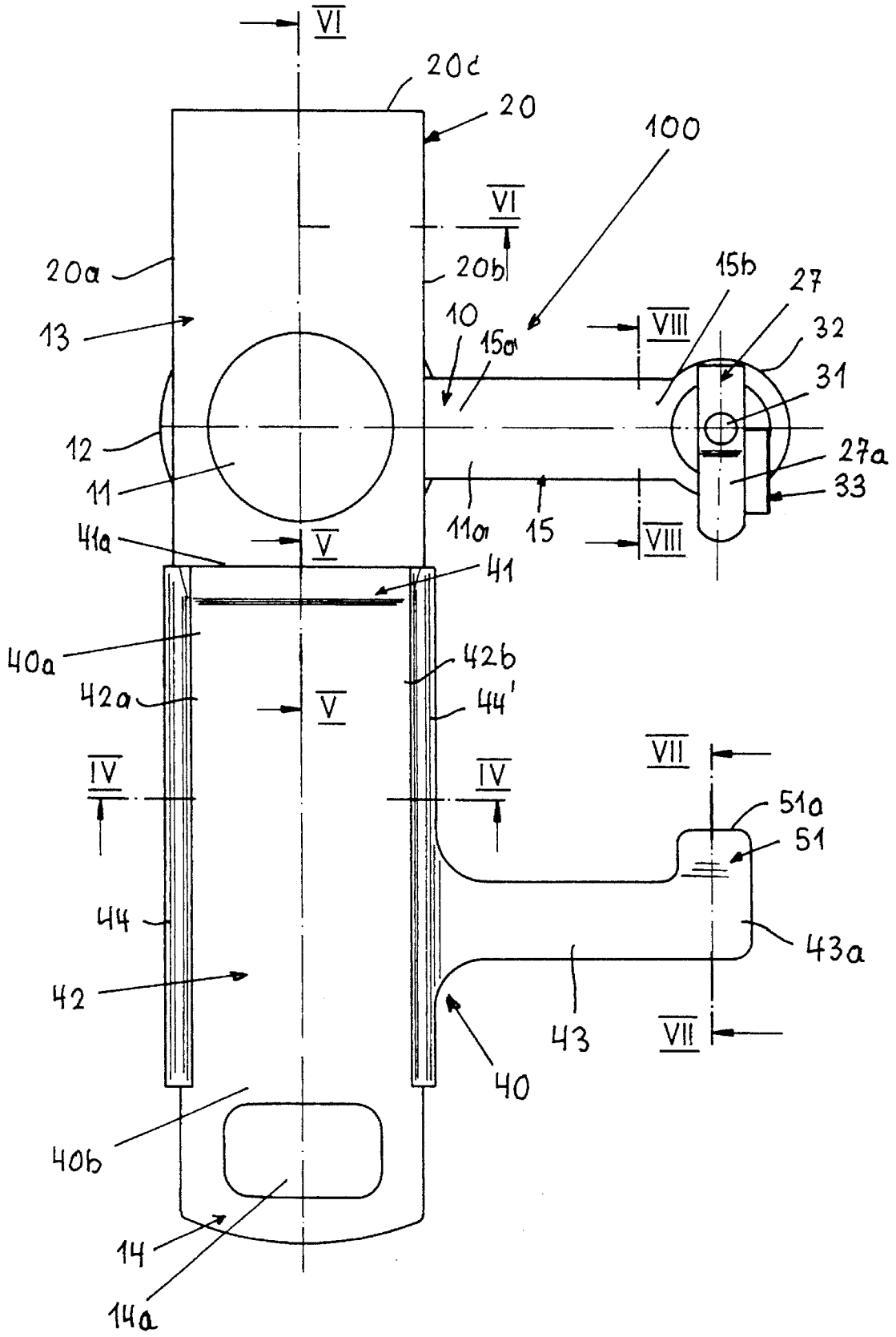
FIG. 3 is a top view of the cutting-off device in a position in which the slider releases the dispensing apertures of the device.
Figure 11:
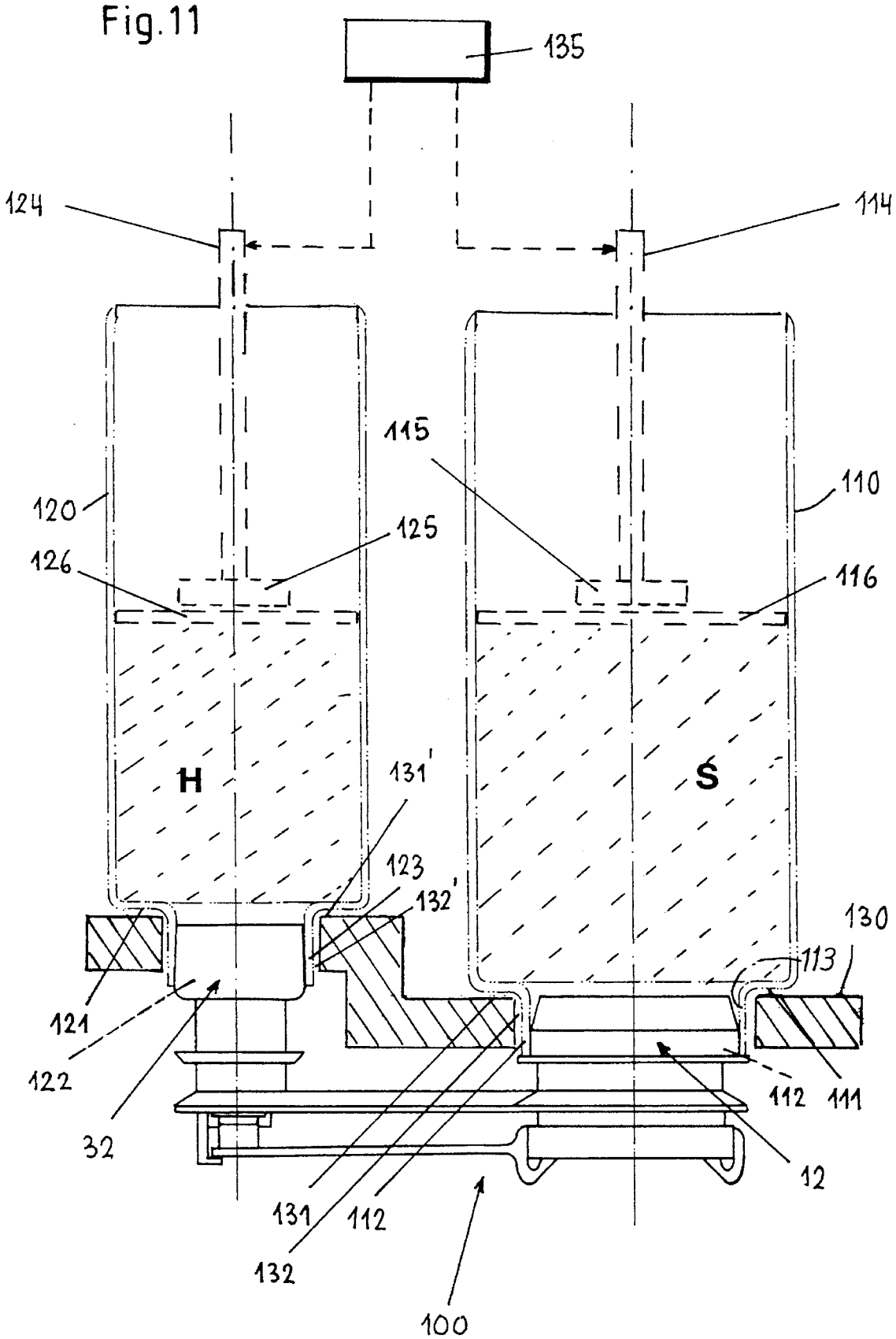
FIG. 11 is a side view of the cutting-off device mounted on two containers disposed in a supporting frame.

As shown in FIGS. 1, 2 and 3, the device 100 for cutting-off viscous stock materials dispensed simultaneously from can-shaped containers 110, 120, more particularly filler materials or putties and hardener pastes, includes a mounting plate 10 with two connection pieces 12, 32 which can be mounted upon the discharge orifices 112, 122 of the two containers 110, 120 and have two dispensing apertures 11, 31 for the stock material and the hardener paste. A slider 40 is guided on the mounting plate 10 fitted with two cutters 41, 51, wherein the dispensing apertures 11, 31 in the mounting plate 10 are located in the path of movement of the cutters 41, 51, (FIG. 11).

The mounting plate 10 is provided with a first dispensing aperture 11 for the stock material and a second dispensing aperture 31 for the hardener paste disposed at the a distance from the first aperture 11. On the mounting plate 10, within the area of each dispensing aperture 11, 31, a connection piece each 12, 32 is mounted so as to interact with the respective discharge aperture 112, 122 of each container 110, 120. Both connection pieces 12, 32 are constructed in such a way that they are insertable either into the discharge apertures 112, 122 in the bottom plates 111, 121 of the containers 110, 120 or that they can be mounted on the dispensing connecting pieces 113, 123 formed onto the bottom plates 111, 121 of the containers 110, 120 and possessing the discharge apertures 112, 122. In the embodiment depicted in FIG. 11, the connection pieces 12, 32 of the mounting plate 10 of the cutting-off device 100 are fitted onto the dispensing connecting pieces 113, 123 whose apertures form the discharge orifices 112, 122 for the stock material and the hardener paste. The container 110 contains the filler material S and the container 120 the hardener paste H.

On the side of the mounting plate 11*a* facing away from the connection piece 12, 32, a first guideway 13 and a second guideway 33 are provided for the slider 40. The slider 40 has a grip 14 and closes the dispensing apertures 11, 31 in the mounting plate 10. The slider 40 is provided with two cutters 41, 51 that can be moved into the areas of the dispensing apertures 11, 31 in the mounting plate 10.

In the embodiment depicted in FIGS. 1 through 3 and 9 and 10, the mounting plate 10 with the dispensing apertures 11, 31 and the two connection pieces 12, 32 are constructed in a web-like fashion, wherein the web 15 carries on its two ends 15*a*, 15*b* the connection pieces 12, 32 with the dispensing apertures 11, 31 (FIG. 1).

Within the region of the first dispensing aperture 11 for the stock material, the web 15 has a first guideway 13 in the form of an approximately rectangular guide plate 20 for the first cutter 41 for the stock material.

Within the region of the second dispensing aperture 31 for the hardener paste, the web 15 of the mounting plate 10 has laterally of the dispensing aperture 31 for the hardener paste a second guideway 33 for the cutter 51 for the hardener paste, this guideway 33 being constructed in such a way that the cutter 51 is guided and kept down on the guideway in which the dispensing aperture for the hardener paste is located.

The guide plate 20 is preferably composed of a rectangular blank, expediently of a plastic, whose longitudinal side edges are identified with 20*a*, 20*b* and whose narrow side edges are identified with 20*c*, 20*d*.

The slider 40 is also composed of a rectangular and plate-shaped blank 42 with longitudinal side edges 42*a*, 42*b* and narrow side edges 42*c*, 42*d*. The two ends of the plate-shaped blank 42 are identified with 40*a*, 40*b*. In the terminal area 40*b* of the plate-shaped blank 42 of the slider 40, the grip aperture 14*a* of the grip 14 is constructed. The end 40*a* facing away from the grip 14 of the plate-shaped blank 42 is constructed in the form of a cutter 41 with the cutting edge 41*a*. The plate-shaped blank 42 of the slider 40 coincides approximately with the configuration and the dimensions of the guide plate 20 of the mounting plate 10 and, within the region of the connection piece 12, the guide plate 20 of the mounting plate 10 has a dispensing aperture 11 for the stock material. The dispensing aperture 11 is larger than the dispensing aperture 31 for the hardener paste. In the closed state, this dispensing aperture 11 for the stock material is covered and closed by the plate-shaped blank 42 and the slider 40.

In addition, the slider 40 has an arm 43 formed onto the plate-shaped blank 42 at a right angle and guided in the second guideway 33 of the mounting plate 10. The second cutter 51 for the hardener paste is constructed on the free end 43*a* of the arm 43. The cutting edge 51*a* of the cutter 51 extends parallel to the cutting edge 41*a* of the first cutter 41 on the plate-shaped blank 42 for the stock material.

Figure 4:
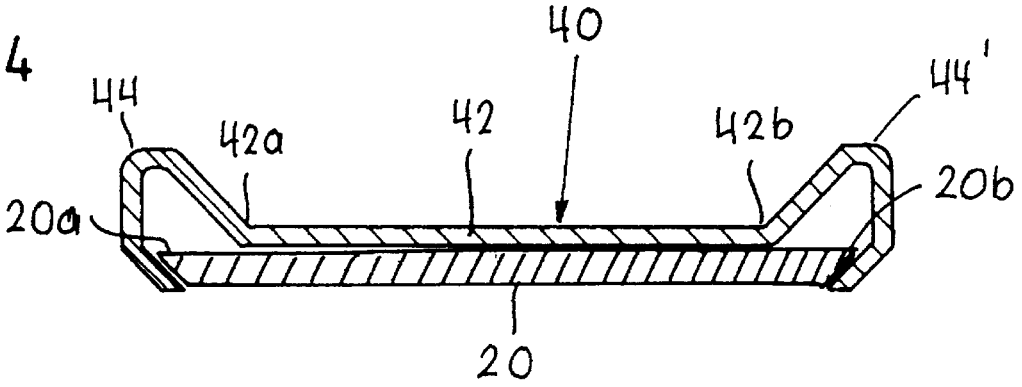
FIG. 4 is a vertical sectional view taken along sectional line IV—IV in FIG. 3.
Figure 5:
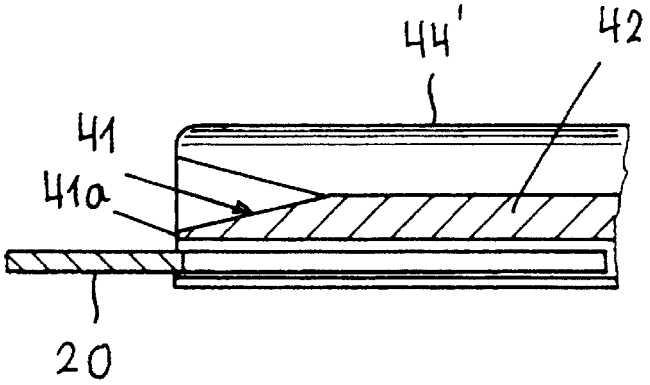
FIG. 5 is a vertical sectional view taken along sectional line V—V in FIG. 3.

For the guidance of the slider 40 with its two cutters 41, 51, the plate-shaped blank 42 of the slider 40 has on its longitudinal side edges 42*a*, 42*b* bead-like sectional webs 44, 44' engaging around the longitudinal edges 20*a*, 20*b* of the guide plate 20 of the first guideway 13, so that the longitudinal side edges 20*a*, 20*b* of the guide plate 20 of the mounting plate 10 engage into these bead-like sectional webs 44, 44'; for this purpose the longitudinal side edges 20*a*, 20*b* of the guide plate 20 are provided with a pertinent profile (FIG. 4). The bead-like construction of the sectional webs 44, 44', which constitute at the same time the guideway for the guide plate 20, provides an increase in the inherent rigidity and stability of the guide plate 20, so that the guide plate 20 is protected against deformation, be it by chemical influences due to the materials used or be it on account of external action.

Figure 6:
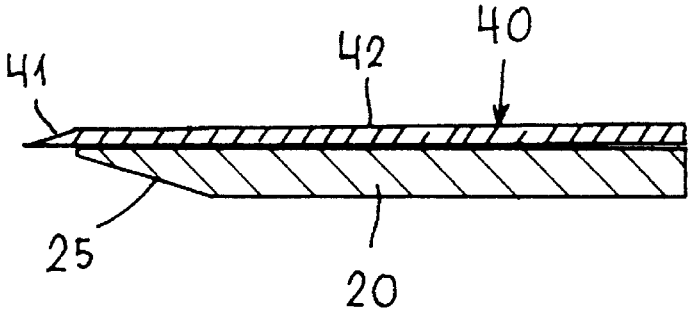
FIG. 6 is a vertical sectional view taken along sectional line VI—VI in FIG. 3.
Figure 7:
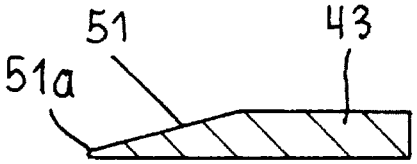
FIG. 7 is a vertical sectional view taken along sectional line VII—VII in FIG. 3.

The guide plate 20 of the first guideway 13 has on the side facing the first cutter 41 of the plate-shaped blank 42 of the slider 40 a bevel 25 which proceeds conically toward the first cutter 41, so that a perfect interaction of the cutter 41 of the slider 40 with the bevel 25 on the guide plate 20 is ensured (FIG. 6).

The rearward end 40*b* with the grip 14 of the plate-shaped blank 42 of the slider 40 has an edge 45 directed toward the guide plate 20 of the first guideway 13 in the form of a delimitation of the path of movement of the slider 40 when the slider 40 assumes a position in which the two dispensing apertures 11, 31 are closed.

Figure 10:
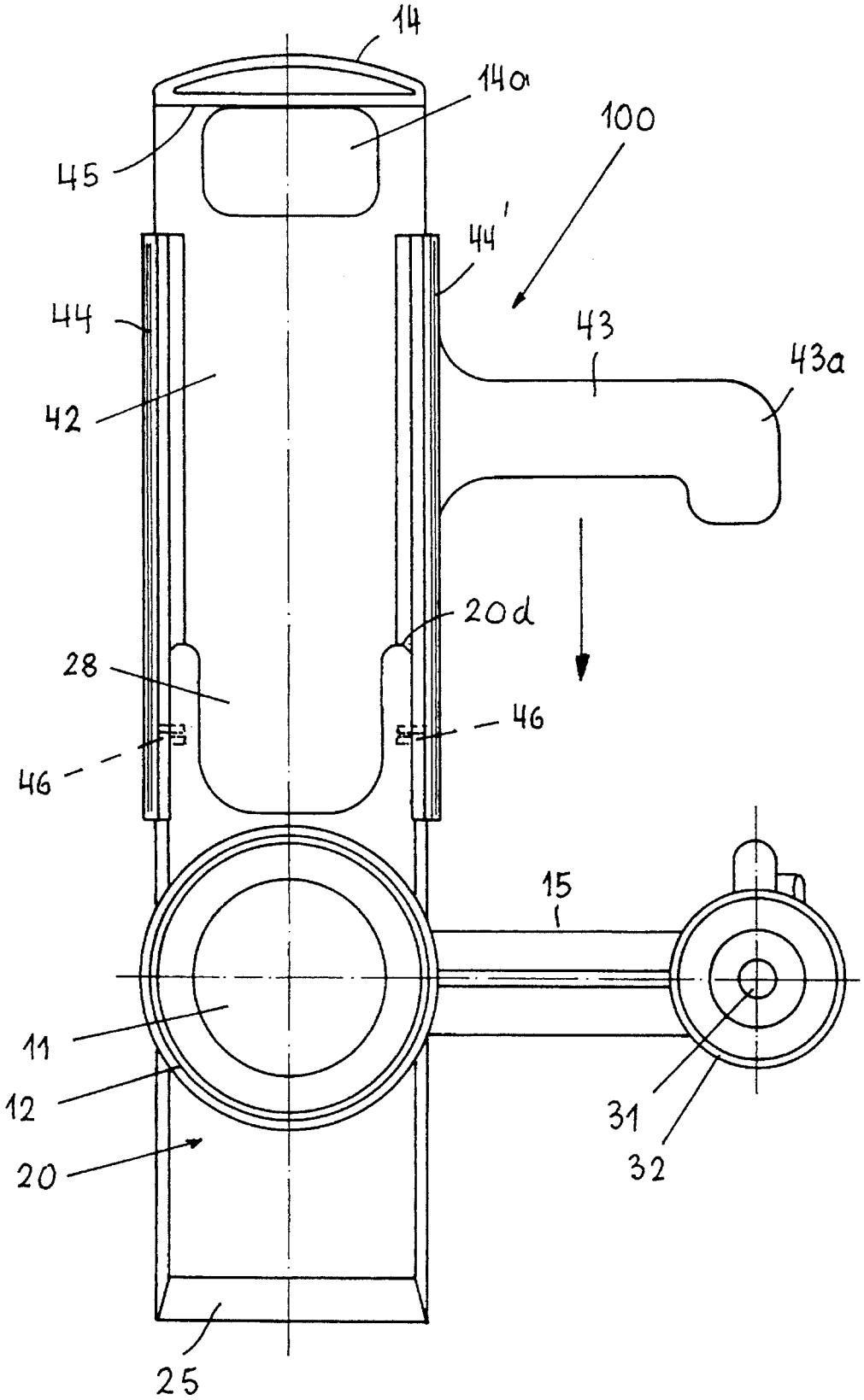
FIG. 10 is a bottom view of the cutting-off device in the position in which the slider releases the dispensing apertures of the device.

The plate-shaped blank 42 of the slider 40, when in its position unblocking the two dispensing apertures 11, 31, can be arrested with the guide plate 20 of the first guideway 13, preferably by means of arresting pins which are indicated with 46 in FIG. 10. This arresting means serves to delimit the terminal position of the slider in the position that unblocks the discharge apertures 11, 31 and it is prevented with the aid of these arresting pins or similar means that the slider 40 can be drawn out from the mounting plate 10.

The plate-shaped blank 42 of the slider 40 is guided while fitting firmly on the guide plate 20, so that, on the one hand, a safe cutting-off of the filter material from the strand of filter material pressed or urged out through the dispensing aperture 11 is ensured and that, on the other hand, in the closing position of the slider 40, both the dispensing aperture 11 for the stock material as well as the dispensing aperture 31 for the hardener paste are closed in an airtight fashion, so that a drying up or hardening of the filler material or of the hardener paste in the dispensing connecting pieces 113, 123 of the two containers 110, 120 cannot take place.

Figure 8:
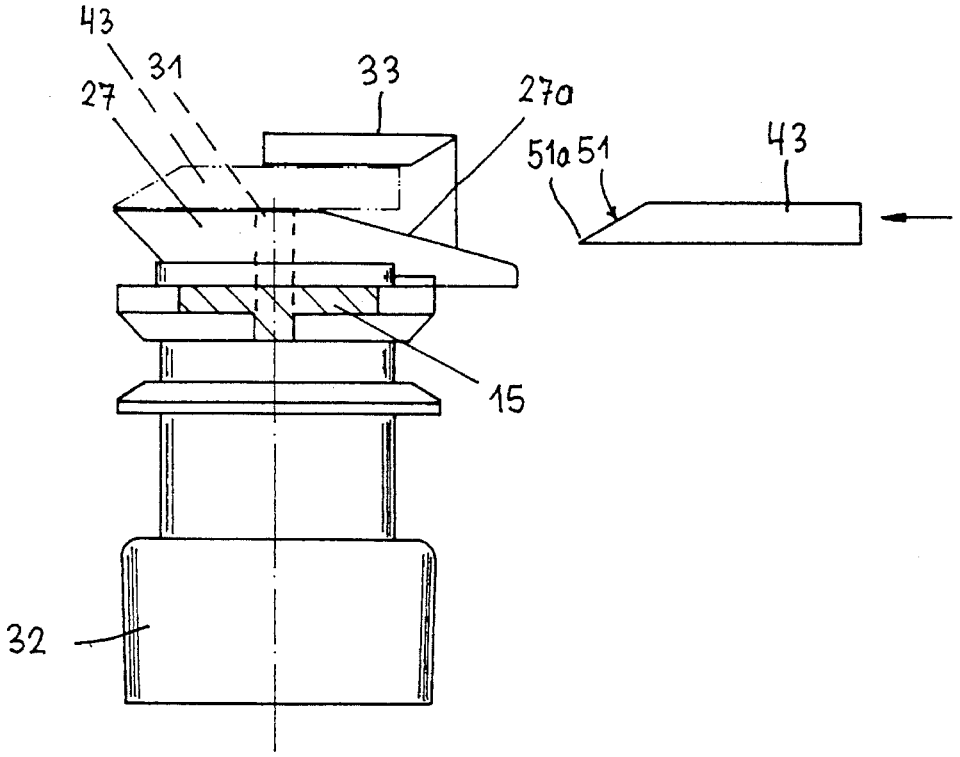
FIG. 8 shows, partly in section, the abutting surface within the region of the dispensing aperture for the hardener paste of the hardener paste cutter of the slider.

Within the area of the second dispensing aperture 31 for the hardener paste and next to the second guideway 33, a guide member 27 for the second cutter 51 is formed on to the web 15 of the mounting plate 10. This guide member 27 possesses a guide surface 27*a* which extends ascendingly toward the second dispensing aperture 31 in the abutting direction of the second cutter 51, and which continues into a horizontal section in which the second dispensing aperture 31 is located (FIG. 8).

Figure 9:
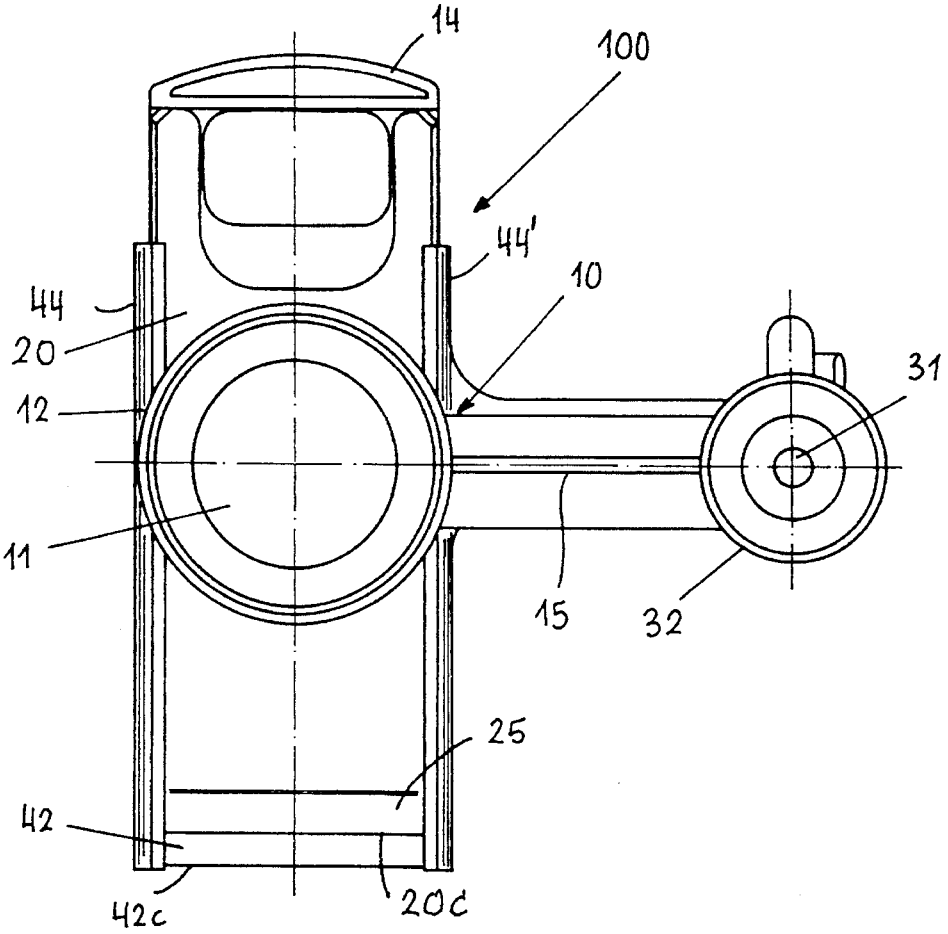
FIG. 9 is a bottom view of the cutting-off device in the position in which the slider closes the dispensing apertures of the device.

Within the region of the grip 14 in the form of a grip opening 14*a* in the plate-shaped blank 42 of the slider 40, the guide plate 20 of the mounting plate 10 has an approximately U-shaped recess 28 which coincides with the grip opening 14*a* (FIGS. 9 and 10).

The guide plate 20 of the mounting plate 10 is shorter than the plate-shaped blank 42 of the slider 40. The distance between the narrow side edge 20*c* of the guide plate 20 the edge 42*c* and of the plate-shaped blank 42 is approximately 1–2 mm; this means that, when dispensing apertures 11, 31 are closed after a slider actuation, the narrow side edge 20*c* of the guide plate 20 and the narrow side edge 42*c* of the plate-shaped blank 42 are spaced from each other as a distance of 1–2 mm (FIG. 6).

The guide plate 20 of the mounting plate 10 with the plate-shaped blank 42 of the slider 40 and the web 15 of the mounting plate 10 are constructed approximately coincident with the arm 43 of the plate-shaped blank 42. The mounting plate 10 with the guideways 13, 33 and the connection pieces 12, 32 is constructed so as to constitute a single mounting piece. In the same manner, the slider 40 with its arm 43 and the two cutters 41 and 51 is constructed so as to form a single piece.

All the components of the cutting-off device 100 are comprised of plastics, preferably elastic plastic. It is possible, however, for other suitable materials to be employed in the manufacture of the cutting-off device 100.

The cutting-off device 100 is employed wherever filler materials and hardener pastes are removed from two containers and dispensed onto a spatula, wherein the two materials are mixed on the spatula and the finished product is used for repair work. The can-shaped containers 110, 120 which accommodate the stock material and the hardener paste are then disposed in the fixtures known per se or in a supporting frame or structure, which is preferably provided with plate-like centering mounting means 131, 131' [and] which, in turn, are provided with perforations 132, 132' for passing the dispensing connecting piece 113, 123 with the discharge orifices 112, 122 on the bottom plates 111, 121 of the two containers 110, 120 through the perforation 132, 132' The supporting frame 130 accommodating the containers 110, 120 can be constructed in the form of a wall-mounted fixture or of a floor-mounted fixture. In their interiors, both containers 110, 120 are provided with pressing covers 116, 126 lying on the container contents, wherein piston plates 115, 125 connected to piston rods 114, 124 act upon the covers 116, 126. The piston rods 114, 124 are in connection with a drive indicated with 135 in FIG. 11, which may be an electromotive drive; the possibility also exists for effecting the drive hydraulically or with the aid of compressed air.

After the insertion of the containers 110, 120 into the supporting frame 130 and following the unblocking of the discharge orifices 12, 122 of the dispensing connecting pieces 113, 123, the cutting-off device 100 is mounted on the containers in such a way that the connection pieces 12, 32 of the containers 110, 120 are inserted in the orifices 112, 122 in a stopper-like fashion. The cutting-off device 100 is thus retained by means of force fit in the discharge orifices 112, 122 of the containers 110, 120. If the cutting-off device 100 assumes the closing position shown in FIG. 2, a tight sealing exists for the discharge orifices 112, 122 of the containers 110, 120.

When the slider 40 is opened, the dispensing apertures 11, 31 of the cutting-off device 100 are unblocked, so that the pressurized materials or the materials acted upon by compressed air in the containers 110, 120 are able to flow out and can be collected on the spatula held underneath the cutting-off device. After the required materials have been obtained, the slider 40 is closed when the this is done, the material strands are cut. During the cutting-off operation, the dispensing apertures 11, 31 of the cutting-off device 100 are at the same time closed once more (FIG. 3).

The connection pieces 12, 32 of the cutting-off device 100 possess dimensions which make an introduction into the discharge orifices 112, 122 of the containers 110, 120 possible even when these discharge orifices possess different dimensions varying from container type to container type. The web 15 of the mounting plate 10 and the arm 43 of the plate-shaped blank 42 of the slider 40 possess a length which permits a mounting of the cutting-off device 100 upon commercially available can-like containers 110, 120. In order to render the cutting-off device 100 also adaptable to containers having different dimensions, the web 15 and the arm 43 are constructed so as to be variable in their lengths. For this purpose, the web 15 and the arm 43 are constructed in two or more parts and provided with guideways in such a fashion that the two parts of the web 15 and of the arm 43 can be pushed together or pulled apart to obtain the necessary length. Arresting means are provided for locking the length of web 15 and arm 43.

What is claimed is:

1. A cutting device for simultaneously cutting a first material dispensed from a first can-shaped container and a second material dispensed from a second can-shaped container, each container having an interior and a discharge orifice, the containers being mounted in a support structure comprising centering mounting means for the containers and means for simultaneously pressing out the materials from the containers, the pressing means comprising simultaneously operable piston rods with piston plates attached to ends of the piston rods and displaceable in the interiors of the containers in a direction toward the discharge orifices, the cutting device being mounting one of on and in the discharge orifices of the containers, the cutting device further comprising a mounting plate having a first dispensing aperture for dispensing the first material and a second dispensing aperture for dispensing the second material, the first dispensing aperture being spaced apart from the second dispensing aperture, the mounting plate comprising first and second connection pieces, wherein the first connection piece is in communication with the first discharge orifice and the second connection piece is in communication with the second discharge orifice, and wherein, on a side of the mounting plate facing away from the connection pieces, the mounting plate has first and second guideways, a slider having two cutters being movably mounted on the guideways, whereby, when the slider is moved relative to the guideways, the cutters cut the first and second materials being dispensed from the first and second containers and subsequently close the first and second dispensing apertures of the mounting plate.

2. The cutting device according to claim 1, wherein the mounting plate with the dispensing apertures and the connection pieces has the shape of a web, the web having two ends, the connection pieces being mounted at the two ends, the first guideway being a guide plate attached to the web at the first dispensing aperture and the second guideway being mounted at the second end of the web laterally of the second dispensing opening, and wherein the slider comprises a plate-shaped blank having first and second ends, the first end comprising a handle and the second end having the first cutter, the slider further comprising an arm attached to the plate-shaped blank at a right angle to a longitudinal axis of the plate-shaped blank, the second cutter being provided on the second end of the arm and being guided by the second guideway, wherein the first and second cutters have cutting edges, wherein the cutting edge of the first cutter extends parallel to the cutting edge of the second cutter.

3. The cutting device according to claim 2, wherein the plate-shaped blank of the slider has longitudinal side edges, the longitudinal side edges of the plate-shaped blank comprising bead-like sectional webs engaging around the first guideway.

4. The cutting device according to claim 2, wherein, on a side facing the first cutter of the plate-shaped blank, the guide plate of the first guideway comprises a bevel inclined conically in a direction toward the first cutter.

5. The cutting device according to claim 2, wherein the grip comprises an edge directed toward the guide plate of the first guideway for limiting a path of movement of the slider in a position in which the slider closes the two dispensing apertures.

6. The cutting device according to claim 2, wherein the guide plate of the first guideway comprises arresting pins for locking the plate-shaped blank of the slider in a position in which the two dispensing apertures are unblocked.

7. The cutting device according to claim 2, wherein the second guideway for the second cutter comprises a section attached to the free end of the web, the section comprising a wall section extending vertically relative to the web and an angled portion attached to the wall section and extending parallel to the web.

8. The cutting device according to claim 2, further comprising a guide member attached to the web at the second dispensing aperture, the guide member having a guiding surface, the guiding surface being upwardly inclined toward the second dispensing aperture.

9. The cutting device according to claim 2, wherein the grip is a grip opening in the plate-shaped blank of the slider, the guide plate having an essentially U-shaped recess movable into a position in which it coincides with the grip opening.

10. The cutting device according to claim 2, wherein the guide plate of the mounting plate and the plate-shaped blank of the slider each have a length, wherein the length of the guide plate is shorter than the length of the plate-shaped blank.

11. The cutting device according to claim 2, wherein the guide plate of the mounting plate and the plate-shaped blank of the slider are essentially congruent and wherein the web of the mounting plate and the arm of the plate-shaped blank are essentially congruent.

12. The cutting device according to claim 2, wherein the mounting plate is integrally connected to the connection pieces and the guideways.

13. The cutting device according to claim 2, wherein the slider is integrally connected to the arm and the two cutters.

14. The cutting device according to claim 2, wherein the mounting plate with the guideways and the connection pieces and the slider with the arm and the two cutters are of a plastic material.

15. The cutting device according to claim 14, wherein the plastic material of the mounting plate with the guideways and the connection pieces has a different degree of hardness than the plastic material of the slider with the arm and the two cutters.

16. The cutting device according to claim 2, wherein the mounting plate with the guideways and the connection pieces are of an elastic plastic material and the slider with the arm and the two cutters are of a hard plastic material.

17. The cutting device according to claim 2, wherein the cutters including the cutting edges are of the same material as the slider.

18. The cutting device according to claim 2, wherein the web of the mounting plate and the arm of the slider each have an adjustable length.

* * * * *